United States Patent [19]

Carlos

[11] 4,424,107

[45] Jan. 3, 1984

[54] ORGANIC SURFACTANT OXIDATION PROMOTERS FOR HYDROCARBONS

[75] Inventor: Donald D. Carlos, Louisville, Ky.

[73] Assignee: Ashland Oil, Inc., Ashland, Ky.

[21] Appl. No.: 255,943

[22] Filed: Apr. 20, 1981

[51] Int. Cl.[3] ..... C07C 27/10; C10G 3/00; C10G 27/00; C10G 27/06

[52] U.S. Cl. ..... 208/3; 208/4; 208/6

[58] Field of Search ..... 208/3, 4, 6

[56] References Cited

U.S. PATENT DOCUMENTS

| | | | |
|---|---|---|---|
| 2,383,701 | 8/1945 | Becker et al. | 208/4 |
| 2,770,594 | 11/1956 | Jezl | 208/3 |
| 3,440,073 | 4/1969 | Fowler | 208/6 |
| 4,192,812 | 3/1980 | Carlos | 208/3 |
| 4,198,285 | 4/1980 | Carlos | 208/3 |

FOREIGN PATENT DOCUMENTS

| | | | |
|---|---|---|---|
| 17101 | of 1929 | Australia | 208/4 |
| 642932 | 6/1962 | Canada | 208/4 |

*Primary Examiner*—Delbert E. Gantz
*Assistant Examiner*—Helane E. Maull
*Attorney, Agent, or Firm*—Sughrue, Mion, Zinn, Macpeak & Seas

[57] ABSTRACT

Liquid hydrocarbons are oxidized in the presence of an organic surfactant promoter.

33 Claims, No Drawings

ORGANIC SURFACTANT OXIDATION PROMOTERS FOR HYDROCARBONS

BACKGROUND OF THE INVENTION

The present invention relates to the oxidation of hydrocarbons. More specifically, the present invention relates to the oxidation of hydrocarbon waxes and petrolatums. Oxidized petroleum fractions including waxes and petrolatums have, in the past, been employed as the source of saponifiable material in the production of lubricating greases and in the formulation of protective coatings. The oxidates employed for these purposes have been obtained by oxidizing selected petroleum fractions under controlled conditions such that the oxidation proceeds only to a limited extent.

Oxidation of petroleum fractions by the above-described method had, associated with it, certain difficulties. Some petroleum fractions are not easily oxidized by the prior art processes and even though oxidizable, in some instances, require a preliminary induction period before the rate of oxidation becomes appreciable. Another problem associated with oxidizing petrolatums is the discoloration of the final wax product rendering it aesthetically unattractive for use in some formulations.

Other problems involve the presence of various oxidation inhibitors in the hydrocarbon fraction. These oxidation inhibitors are often nitrogen and/or sulfur-containing compounds present as impurities in the hydrocarbon source.

To overcome the above problems, the prior art suggests the employment of various oxidation catalysts, such as redox catalysts with or without promoters, for use in the hydrocarbon oxidation process. The redox catalysts are often based on expensive redox metals, such as manganese, chromium and the like. The present inventor is not aware of any prior art relevant to the use of the organic surfactants of the present invention as hydrocarbon oxidation promoters.

SUMMARY OF THE INVENTION

An object of this invention is to provide an improved process for the oxidation of hydrocarbon waxes and petrolatums using an oxidizing gas.

Another object of this invention is to provide a process for oxidizing hydrocarbon waxes and petrolatums more easily than has heretofore been possible.

A further object of this invention is to provide a process for oxidizing hydrocarbon fractions containing redox metal catalyst poisoners.

Still another object of this invention is to provide improved hydrocarbon oxidates characterized by superior color and reduced odor, without the need of expensive metal redox catalysts.

Another object of this invention is to provide an improved process for the oxidation of hydrocarbons not requiring an induction period while providing a controlled rate of oxidation to oxidates of high acid number.

Other objects of this invention will be apparent to the skilled artisan.

In accordance with the present invention, the oxidation of hydrocarbons is carried out by blowing an oxidizing gas through a liquid or molten mass of hydrocarbons in the presence of an oxidation promoting amount of an organic surfactant.

More specifically, in the present invention, an oxidation promoting amount of an organic surfactant selected from the group consisting of an organic sulfonate salt, an organic phosphate salt, a nitrogen betaine salt, an organic sulfate salt and a polyalkyleneoxide, or mixtures thereof is used to promote gaseous oxidation of liquid or molten hydrocarbons. In preferred embodiments, a small amount of water is used as a dispersant aid for the organic surfactant promoter. In other preferred embodiments, a basic material is also present during the oxidation to form salts of the free acids of organic sulfate, sulfonate and phosphate esters.

In preferred embodiments of the present invention, the organic surfactant oxidation promoter is present in an amount of about 0.05 to 2.0 parts by weight per 100 parts of hydrocarbon feed having an average number of carbon atoms per molecule of 20 to 100.

The oxidation is conducted under suitable conditions of gas flow, pressure and temperature to oxidize the hydrocarbon wax or petrolatum to a predetermined acid number.

DETAILED DESCRIPTION OF THE INVENTION

As disclosed above, in the present invention, the important characteristic of the promoter is that it possesses surfactant properties. More specifically, the promoter in this invention is an organic-based compound possessing surfactant characteristics.

Surfactants are extremely well-known materials widely used in cosmetics, wetting agents, detergents, etc. The surfactant compounds are so useful due to their surface-active properties, i.e., they alter the interfacial tensions which exist between the various phases present in a system. Although the present invention basically involves a non-aqueous reaction medium, it is believed that the surface active properties of the organic surfactants are involved in their "promoting" effect.

In general, organic surfactants may be classified into three broad categories, nonionic, anionic and cationic. In addition, certain types of organic surfactants include both a negatively charged atom and a positively charged atom, for example betaines, in their molecules, and for purposes of this invention will be considered amphoteric.

Long chain organic sulfonates constitute one group of organic surfactants usable in the present invention. These promoter materials can broadly be represented by the formula:

$$R—SO_3^-M^+$$

where R is a long chain organic moiety which will be predominately aliphatic, but which may contain aromatic content. Long chain alkyl and alkylaryl sulfonic acid salts are preferred. R will usually contain about 10 to 30 carbon atoms, preferably about 12 to 18 carbon atoms, can be branched or straight chained, can contain some unsaturation (i.e. alkylene chains) and could include some substitution, such as an OH group or the like. M is a suitable cation such as an alkali metal, an alkaline earth metal or the ammonium ion. Preferably M is an alkali metal such as Na or K.

Included with the long chain organic sulfonates usable in the present invention are the petroleum sulfonates, which may not fall within the above formula depending upon base feed stock and "sulfonation" agent.

As specific organic sulfonates usable in the present invention, there may be mentioned sodium 1-dodecanesulfonate, MORCO H-62 (believed to be a sodium petroleum sulfonate and available from Marathon Morco Co.), sodium hexadecane sulfonate and sodium nonylbenzene sulfonates.

A second class of organic surfactants which can be employed as the oxidation promoters of this invention is the organic phosphate salts, more specifically the long chain aliphatic phosphate salts of the formula (A) and/or (B)

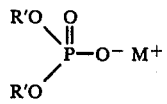

(A)

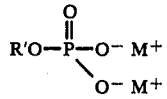

(B)

containing little if any aromatic content.

R', each of which can be the same or be different in formula (A), is a long chain organic moiety, of say up to 30 carbon atoms, which is predominately aliphatic, but which can contain some aromatic content, can be branched or straight chain, can contain some unsaturation and can be substituted, such as by OH or the like. Preferably the organic phosphate will be a long chain alkyl phosphate containing about 10 to 30 carbon atoms, preferably about 12 to 18 carbon atoms.

M is as defined above but additionally including divalent cation possibilities.

A specific organic phosphates usable in the present invention, there may be mentioned the salts of dodecylphosphate, Varifos 2611 (believed to be the free acid of complex organic phosphate esters and available from Ashland Chemical Co.), hexadecane phosphate, didodecyl phosphate, dihexadecane phosphate and dodecyl hexadecane phosphate.

The nitrogen betaine salts are another type of organic surfactant which can function as the hydrocarbon oxidation promoter of this invention. These materials can be represented by the following formula:

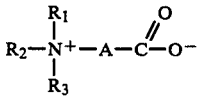

wherein at least one of $R_1$, $R_2$ and $R_3$ is a long chain hydrocarbon moiety which can contain atoms other than carbon and hydrogen, for example, amido groups, and the remainder of $R_1$, $R_2$ and $R_3$ are methyl groups. A is a divalent linking moiety, such as an alkylene chain of 1 to 6 carbon atoms, preferably methylene. These hydrocarbon chains may be branched or straight chained and will contain about 10 to 30 carbon atoms, preferably about 12 to 18 carbon atoms. Specific examples of nitrogen betaine salts usable in this invention are cocoamido betaine, coco betaine and stearyl betaine.

Another class of organic surfactants useful in the practice of the present invention are the organic sulfate ester salts. In this class of compounds, which are well known to the skilled artisan as are the other surfactants used in this invention, there are the long chain predominantly aliphatic, preferably alkyl, sulfate salts of the formula $$R^2SO_4^-M^+ \text{ or } R^2O-SO_3^-M^+$$

wherein $R^2$ contains about 10 to 30 carbon atoms, preferably about 12 to 18 carbon atoms. M is as defined above. Sodium lauryl sulfate, potassium lauryl sulfate, calcium hexadecyl sulfate, sodium dodecyl sulfate and sodium hexadecyl sulfate are examples of this type of material. Preferably, $R^2$ is straight chain alkyl.

A further class of organic surfactants useful as hydrocarbon oxidation promoters is the nonionic polyalkylene oxide compounds. These compounds are usually based on repeating ethylene oxide and/or propylene oxide units, and at times contain another alkoxy, or aryloxy group at one end of the molecule. Many of the nonionics will fall within the following formula $$R_5-O-(CH_2CH_2O)_n(CH_2CH_2CH_2O)_mH$$

where $R_5$ is alkyl, aryl, alkylaryl, or the like.

A listing of specific types of nonionic surfactants useful in the present invention could include the polyethylene oxides, the alkylphenoxy-polyethoxyethanols, polypropylene oxides, primary alcohol—ethylene oxide adducts and polyethoxylated castor oil.

In a preferred embodiment, a small amount of a basic material, such as a hydroxide, a carbonate, a bicarbonate or a carboxylate is included in the formulation for the purpose of forming a surfactant salt. These materials can be used in an amount sufficient to be certain that any free acid surfactant present will be converted to a salt form, for example, about 0.01 to 1.0, preferably 0.05 to 0.2 parts per 100 parts of hydrocarbon feed. As examples of these basic compounds, there may be mentioned sodium hydroxide, potassium hydroxide, calcium carbonate, sodium bicarbonate, ammonium carbonate, sodium formate, potassium stearate, etc. In general, these compounds are the alkali metal, alkaline earth metal or ammonium hydroxides, carbonates, bicarbonates and carboxylates (about formate through stearate).

Preferably, the promoter compound of this invention will be added to the hydrocarbon feed in the form of an aqueous solution or dispersion since it is preferred to have a small amount of water, say about up to 4 parts by weight per 100 parts of hydrocarbon feed, present during the oxidation. Furthermore, often the water facilitates dispersion of the surfactant throughout the hydrocarbons.

The promoter compound is preferably present in 0.1 to 1.0 parts per 100 parts of hydrocarbon feed.

The hydrocarbons useful in this process include the conventional feedstocks used as oxidizer feedstock. Ordinarily, such a feedstock comprises a mixture of saturated hydrocarbons having an average number of carbon atoms per molecule of 20 to 100, preferably 25 to 50. Waxes and petrolatums from crude oil refining, hydrocarbon mixtures from lubricant plants and the like are examples of suitable feedstocks.

Ordinarily, the process will be carried out as a batch process. Air or another oxidizing gas is forced through the reaction mixture of hydrocarbon and promotoer compound at a rate of between 0.5 and 10 liters, preferably 3.5 to 4.0 liters (measured at 760 mm of mercury and 25° C.) per liter of hydrocarbon per minute at a temperature of between 150° and 180° C., preferably 160° to 165° C. Ordinarily, the temperature will rise as the oxidation proceeds so that only minimal heat may be required for the oxidation. The oxidation process is conducted at a pressure of between 50 and 400 psig (4.4–28.2 atmospheres), preferably 150 to 250 psig. The process is discontinued when a desired acid number is reached. The term "acid number" is defined to mean the number of milligrams of potassium hydroxide required to neutralize 1 gram of sample. Generally, the reaction will be carried out for about 0.25 to 10 hours, preferably about 1 to 5 hours to reach a predetermined acid number.

EXAMPLE 1

A number of air oxidations were conducted in laboratory tests using a one liter Parr bomb. In each test, the reactor charge amounted to approximately 500 cc of hydrocarbon. To the hydrocarbon material there was added the amount of organic surfactant as shown in the accompanying table. For comparison purposes, some runs were carried out in the absence of the organic surfactant promoter compound. As indicated, the reaction conditions were approximately 1 hour or 3 hours for each reaction at a temperature of approximately 320° to 330° F., a pressure of 150 to 200 psig and an air input rate of 1.9 liters of air per minute (measured at 25° C. and one atmosphere). Acid number determinations were made at the end of each run.

TABLE 1

| Run No. | Hydrocarbon Type | Percentage by Weight Promoter Added | Reaction Time (hours) | Pressure (psig) | Acid Number |
|---|---|---|---|---|---|
| 1-A | (1) | 0.5% sodium lauryl sulfate in 10 cc water | 3 | 200 | 44.3 |
| 1-B | (1) | 0.25% dodecyl hydrogen sulfate + 0.05% KOH in 5 cc water | 3 | 200 | 47.3 |
| 1-C | (1) | 0.25% hexadecyl hydrogen sulfate + 0.05% lime in 5 cc water | 3 | 150 | 45.4 |
| 1-D | (1) | 0.5% hexadecyl hydrogen sulfate + 0.05% $Na_2CO_3$ in 5 cc water | 3 | 150 | 48.8 |
| 1-E | (1) | None | 3 | 200 | 1.6 |
| 1-F | (1) | 0.25% Triton X-100 in 5 cc water | 3 | 150 | 48.1 |
| 1-G | (1) | 0.25% T-DET N-507 in 10 cc water | 3 | 150 | 46.5 |
| 1-H | (1) | 0.5% VARION CADG in 10 cc water | 3 | 200 | 54.4 |
| 1-I | (1) | 0.25% Morco H-62 in 10 cc water | 3 | 150 | 48.4 |
| 1-J | (1) | 0.125% sodium 1-dodecane sulfonate | 3 | 150 | 51.0 |
| 1-K | (1) | 0.5% dodecyl phosphate + 0.05% $Ca(OH)_2$ in 5 cc water | 3 | 150 | 39.6 |
| 1-L | (1) | Same as 1-K without the dodecyl phosphate | 3 | 150 | 2.5 |
| 2-A | (2) | 0.5% Triton X-100 | 1 | 200 | 15.3 |
| 2-B | (2) | None | 3 | 200 | 0.7 |
| 3-A | (3) | 1% VARION CADG | 3 | 200 | 37.7 |
| 3-B | (3) | 1% Varifos 2611 + 0.1% NaOH in 5 cc water | 3 | 200 | 33.3 |
| 3-C | (3) | Same as 3-B without the Varifos 2611 | 3 | 200 | 2.4 |
| 4-A | (4) | 1% VARION CADG | 3 | 200 | 37.0 |
| 4-B | (4) | None | 3 | 200 | 0.4 |
| 4-C | (4) | 0.25% sodium 1-dodecane sulfonate in 5 cc water | 3 | 200 | 39.4 |
| 5-A | (5) | 1% MORCO H-62 in 10 cc water | 3 | 200 | 34.4 |
| 6-A | (6) | 0.5% Varifos 2611 + 0.05% KOH in 5 cc water | 3 | 200 | 49.0 |
| 6-B | (6) | 0.25% dodecyl phosphate + 0.05% $Na_2CO_3$ in 5 cc water | 3 | 200 | 50.2 |
| 6-C | (6) | Same as 6-B without the dodecyl phosphate | 3 | 200 | 3.1 |
| 6-D | (6) | Same as 6-A without the Varifos 2611 | 3 | 200 | 1.1 |

(1) 250 N (neutral) wax from a mixture of Iranian Rostam and Louisiana sweet crude.
(2) 100 neutral wax from a lube plant
(3) A pilot plant petrolatum
(4) 330 neutral wax from a lube plant
(5) A petrolatum.
(6) 100 N wax from a mixture of Iranian Rostam and Louisiana sweet crude.
Triton X-100 is an octylphenoxy polyethoxy ethanol nonionic surfactant available from Rohm and Haas.
T-DET N-507 is a nonionic surfactant believed to be a nonylphenol - 50 mole ethylene oxide adduct at 70 percent concentration thereof in water - available from Thompson Hayward Chemical Co.
VARION CADG is a cocoamido betaine used as a 32% concentration thereof in water available from Ashland Chemical Co.
MORCO H-62 is a sodium petroleum sulfonate available from Marathon Morco Co.
Varifos 2611 is the free acid of complex organic phosphate esters available from Ashland Chemical Co.

Variations of the invention will be apparent to the skilled artisan.

What is claimed is:

1. A process for oxidizing liquid hydrocarbons comprising saturated hydrocarbons having an average number of carbon atoms per molecule of 20 to 100, said process comprising blowing an oxidizing gas through a liquid mass of said hydrocarbons in the presence of an oxidation promoting amount of an organic surfactant selected from at least one of an organic sulfonate salt selected from the group consisting of alkali metal, alkaline earth metal and ammonium sulfonates, an organic phosphate salt, an organic sulfate salt, a polyalkyleneoxide, or a nitrogen betaine salt of the formula

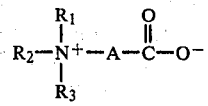

wherein at least one of $R_1$, $R_2$ and $R_3$ is a hydrocarbon radical containing about 10 to 30 carbon atoms, the remainder of $R_1$, $R_2$ and $R_3$ are each methyl and A is a divalent linking group.

2. The process of claim 1 wherein said organic surfactant is present in an amount of 0.1 to 1.0 parts per 100 parts of hydrocarbons, by weight.

3. The process of claim 1 wherein said organic surfactant is present in an amount of 0.05 to 2.0 parts per 100 parts of hydrocarbons, by weight, said hydrocarbons are a mixture of saturated hydrocarbons having an average number of carbon atoms per molecule of 20 to 100 and the surfactant is added admixed with a small amount of water.

4. The process of claim 1 wherein said organic surfactant is present in an amount of 0.05 to 2.0 parts per 100 parts of hydrocarbons, by weight, said hydrocarbons are a mixture of saturated hydrocarbons having an average number of carbon atoms per molecule of 20 to 100 and the surfactant is added admixed with a small amount of water, and wherein air is the oxidizing gas and is blown through the hydrocarbons at a rate of about 0.5 to 10 liters (measured at 760 mm mercury and 25° C.) per liter of hydrocarbons per minute while the reaction is being carried out at about 150° C. to 180° C. under a pressure of about 50 to 400 psig for about 0.25 to 10 hours.

5. The process of claim 4 wherein the amount of organic surfactant is about 0.1 to 1.0 parts per 100 parts of hydrocarbons, by weight, said hydrocarbons having an average number of carbon atoms of 25 to 50, the air is blown at a rate of 3.5 to 4.0 liters per minute per liter of hydrocarbons, the temperature of reaction is 160° C. to 165° C., the pressure is 150 to 250 psig and the reaction is carried out for about 1 to 5 hours.

6. The process of claim 1 where a basic material selected from alkali metal, alkaline earth metal or ammonium hydroxide, carbonate, bicarbonate or carboxylate is also present.

7. The process of claim 2 where a basic material selected from alkali metal, alkaline earth metal or ammonium hydroxide, carbonate, bicarbonate or carboxylate is also present.

8. The process of claim 1 wherein the surfactant is a petroleum sulfonate salt.

9. The process of claim 1 wherein the surfactant is an organic sulfonate of the formula $$R—SO_3^-M^+$$

wherein R is a predominantly aliphatic radical containing about 10 up to about 30 carbon atoms and M is an alkali metal ion, an alkaline earth metal ion or the ammonium ion.

10. The process of claim 9 wherein R is an alkyl or alkylaryl moiety.

11. The process of claims 8, 9 or 10 wherein R contains about 12 to 18 carbon atoms, the surfactant is present in an amount of 0.05 to 2.0 parts per 100 parts of hydrocarbons, by weight, said hydrocarbons are a mixture of saturated hydrocarbons having an average number of carbon atoms per molecule of 20 to 100, wherein air is the oxidizing gas and is blown through the hydrocarbons at a rate of about 0.5 to 10 liters (measured at 760 mm mercury and 25° C.) per liter of hydrocarbons per minute while the reaction is being carried out at about 150° C. to 180° C. under a pressure of about 50 to 400 psig for about 0.25 to 10 hours.

12. The process of claim 11 wherein the amount of surfactant is about 0.1 to 1.0 parts per 100 parts of hydrocarbons, by weight, said hydrocarbon having an average number of carbon atoms of 25 to 50, the surfactant is added admixed with a small amount of water, the air is blown at a rate of 3.5 to 4.0 liters per minute per liter of hydrocarbons, the temperature of reaction is 160° C. to 165° C., the pressure is 150 to 250 psig and the reaction is carried out for about 1 to 5 hours.

13. The process of claim 1 wherein the surfactant is an organic phosphate salt of the formula (A) and/or (B):

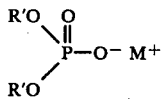

(A)

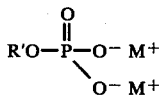

(B)

wherein R′, each of which can be the same or different in formula (A), is a predominantly aliphatic radical containing about 10 up to about 30 carbon atoms and M is a compatible monovalent and/or divalent cation.

14. The process of claim 13 wherein each R′ is alkyl and M is an alkali metal ion, an alkaline earth metal ion or the ammonium ion.

15. The process of claim 14 wherein each R′ is alkyl of about 12 to 18 carbon atoms.

16. The process of claims 13, 14 or 15 wherein the surfactant is present in an amount of 0.05 to 2.0 parts per 100 parts of hydrocarbons, by weight, said hydrocarbons are a mixture of saturated hydrocarbons having an average number of carbon atoms per molecule of 20 to 100, wherein air is the oxidizing gas and is blown through the hydrocarbons at a rate of about 0.5 to 10 liters (measured at 760 mm mercury and 25° C.) per liter of hydrocarbons per minute while the reaction is being carried out at about 150° C. to 180° C. under a pressure of about 50 to 400 psig for about 0.25 to 10 hours.

17. The process of claim 16 wherein the amount of surfactant is about 0.1 to 1.0 parts per 100 parts of hydrocarbons, by weight, said hydrocarbons having an average number of carbon atoms of 25 to 50, the surfactant is added admixed with a small amount of water, the air is blown at a rate of 3.5 to 4.0 liters per minute per liter of hydrocarbons, the temperature of reaction is 160° C. to 165° C., the pressure is 150 to 250 psig and the reaction is carried out for about 1 to 5 hours.

18. The process of claim 1 wherein two of said nitrogen betaine salt substituents $R_1$, $R_2$ and $R_3$ are methyl.

19. The process of claim 18 wherein A is an alkylene chain of 1 to 6 carbon atoms.

20. The process of claim 18 wherein $R_1$ contains about 12 to about 18 carbon atoms.

21. The process of claims 18, 19 or 20 wherein the surfactant is present in an amount of 0.05 to 2.0 parts per 100 parts of hydrocarbons, by weight, said hydrocarbons are a mixture of saturated hydrocarbons having an average number of carbon atoms per molecule of 20 to 100, wherein air is the oxidizing gas and is blown through the hydrocarbons at a rate of about 0.5 to 10 liters (measured at 760 mm mercury and 25° C.) per liter of hydrocarbons per minute while the reaction is being carried out at about 150° C. to 180° C. under a pressure of about 50 to 400 psig for about 0.25 to 10 hours.

22. The process of claim 21 wherein the amount of surfactant is about 0.1 to 1.0 parts per 100 parts of hydrocarbons, by weight, said hydrocarbons having an average number of carbon atoms of 25 to 50, the surfactant is added admixed with a small amount of water, the air is blown at a rate of 3.5 to 4.0 liters per minute per liter of hydrocarbons, the temperature of reaction is 160° C. to 165° C., the pressure is 150 to 250 psig and the reaction is carried out for about 1 to 5 hours.

23. The process of claim 1 wherein the surfactant is a sulfate salt of the formula $$R^2—O—SO_3^-M^+$$

wherein $R^2$ is a predominantly aliphatic radical containing about 10 up to about 30 carbon atoms and M is a compatible monovalent and/or divalent cation.

24. The process of claim 23 wherein $R^2$ is alkyl and M is an alkali metal ion, an alkaline earth metal ion or the ammonium ion.

25. The process of claim 24 wherein $R^2$ contains about 12 to about 18 carbon atoms.

26. The process of claims 23, 24 or 25 wherein the surfactant is present in an amount of 0.05 to 2.0 parts per 100 parts of hydrocarbons, by weight, said hydrocarbons are a mixture of saturated hydrocarbons having an average number of carbon atoms per molecule of 20 to 100, wherein air is the oxidizing gas and is blown through the hydrocarbons at a rate of about 0.5 to 10 liters (measured at 760 mm mercury and 25° C.) per liter of hydrocarbons per minute while the reaction is being carried out at about 150° C. to 180° C. under a pressure of about 50 to 400 psig for about 0.25 to 10 hours.

27. The process of claim 26 wherein the amount of surfactant is about 0.1 to 1.0 parts per 100 parts of hydrocarbons, by weight, said hydrocarbons having an average number of carbon atoms of 25 to 50, the surfactant is added admixed with a small amount of water, the air is blown at a rate of 3.5 to 4.0 liters per minute per liter of hydrocarbons, the temperature of reaction is 160° C. to 165° C., the pressure is 150 to 250 psig and the reaction is carried out for about 1 to 5 hours.

28. The process of claim 1 wherein said surfactant is of the formula:

$$R_5—O—(CH_2CH_2O)_n(CH_2CH_2CH_2O)_mH$$

wherein $R_5$ is alkyl, aryl or alkylaryl.

29. The process of claim 1 wherein the surfactant is a polyethylene oxide, an alkylphenoxy polyethoxyethanol, a polypropylene oxide, a primary alcohol-ethylene oxide adduct, or a polyethoxylate castor oil.

30. The process of claims 28 or 29 wherein the surfactant is present in an amount of 0.05 to 2.0 parts per 100 parts of hydrocarbons, by weight, said hydrocarbons are a mixture of saturated hydrocarbons having an average number of carbon atoms per molecule of 20 to 100, wherein air is the oxidizing gas and is blown through the hydrocarbons at a rate of about 0.5 to 10 liters (measured at 760 mm mercury and 25° C.) per liter of hydrocarbons per minute while the reaction is being carried out at about 150° C. to 180° C. under a pressure of about 50 to 400 psig for about 0.25 to 10 hours.

31. The process of claim 30 wherein the amount of surfactant is about 0.1 to 1.0 parts per 100 parts of hydrocarbons, by weight, said hydrocarbon having an average number of carbon atoms of 25 to 50, the surfactant is added admixed with a small amount of water, the air is blown at a rate of 3.5 to 4.0 liters per minute per liter of hydrocarbons, the temperature of reaction is 160° C. to 165° C., the pressure is 150 to 250 psig and the reaction is carried out for about 1 to 5 hours.

32. The process of claims 8, 9, 13 or 23 wherein a basic compound selected from alkali metal, alkaline earth metal or ammonium hydroxide, carbonate, bicarbonate or carboxylate is present in an amount sufficient to ensure that the surfactant is present in the form of a salt.

33. The process of claim 1 wherein the liquid hydrocarbons are at least one of waxes and petrolatums.

* * * * *